US007900612B2

(12) United States Patent
Knaus et al.

(10) Patent No.: US 7,900,612 B2
(45) Date of Patent: Mar. 8, 2011

(54) VALVE AND CYLINDER HEAD COVER FOR CRANKCASE VENTILATION OF AN INTERNAL COMBUSTION ENGINE

(75) Inventors: Artur Knaus, Hamburg (DE); Wilhelm Seelandt, Rosengarten (DE)

(73) Assignee: Dichtungstechnik G. Bruss GmbH & Co. KG (DE)

( * ) Notice: Subject to any disclaimer, the term of this patent is extended or adjusted under 35 U.S.C. 154(b) by 513 days.

(21) Appl. No.: 12/058,970

(22) Filed: Mar. 31, 2008

(65) Prior Publication Data

US 2008/0257321 A1 Oct. 23, 2008

(30) Foreign Application Priority Data

Apr. 18, 2007 (DE) ..... 10 2007 018 586

(51) Int. Cl.
*F01M 13/02* (2006.01)

(52) U.S. Cl. ..... 123/574

(58) Field of Classification Search ..... 123/572–574, 123/41.86; 137/493.7, 493; 251/325
See application file for complete search history.

(56) References Cited

U.S. PATENT DOCUMENTS

| | | | | |
|---|---|---|---|---|
| 2,407,178 | A | 9/1946 | Roos | |
| 2,742,057 | A * | 4/1956 | Krieck | 138/45 |
| 3,159,176 | A | 12/1964 | Russell et al. | |
| 3,209,738 | A * | 10/1965 | Powers | 123/574 |
| 3,308,798 | A | 3/1967 | Snider | |
| 3,754,538 | A * | 8/1973 | Ephraim et al. | 123/41.86 |
| 3,766,898 | A * | 10/1973 | McMullen | 123/574 |
| 4,686,952 | A | 8/1987 | Zeigler, Jr. et al. | |
| 5,499,604 | A | 3/1996 | Ito et al. | |
| 5,586,541 | A | 12/1996 | Tsai | |
| 5,881,686 | A * | 3/1999 | Schmidt | 123/41.86 |
| 6,553,979 | B2 * | 4/2003 | Albright | 123/574 |
| 7,017,563 | B2 * | 3/2006 | Dworatzek et al. | 123/574 |
| 2003/0213479 | A1 | 11/2003 | Wade | |

FOREIGN PATENT DOCUMENTS

| | | | |
|---|---|---|---|
| DE | 1149957 | A | 6/1963 |
| DE | 1916788 | A | 4/1970 |
| DE | 2702621 | A1 | 8/1977 |
| DE | 10153120 | A1 | 9/2002 |
| DE | 10-2005-043735 | A1 | 3/2007 |
| GB | 1514237 | A | 6/1978 |
| JP | 58-020917 | A | 2/1983 |
| JP | 59-126014 | A | 7/1984 |
| JP | 61-016218 | A | 1/1986 |
| JP | 61-016219 | A | 1/1986 |
| JP | 08-270429 | A | 10/1996 |
| JP | 2003-090207 | A | 3/2003 |
| WO | WO 98/20236 | A1 | 5/1998 |
| WO | WO 2005/116497 | A1 | 12/2005 |

* cited by examiner

*Primary Examiner* — M. McMahon
(74) *Attorney, Agent, or Firm* — Saliwanchik Lloyd & Eisenschenk

(57) ABSTRACT

A valve for crankcase ventilation of an internal combustion engine comprises a fresh-air side for connection with an intake section of the internal combustion engine, an engine side for connection with the crankcase and a valve insert movable as a whole for changing the flow resistance through the valve. Said valve inset is held inside said valve without pre-load. Said valve insert is designed to be freely displaced to a deventilation limit-stop position under negative pressure on the fresh-air side relative to the engine side, and to be freely displaced to a ventilation limit-stop position under excess pressure on the fresh-air side relative to the engine side. The valve insert is designed to open a deventilation cross-section in the deventilation limit-stop position and to open a deventilation cross-section that is different from the ventilation cross-section in the ventilation limit-stop position.

22 Claims, 2 Drawing Sheets

Figure 1:
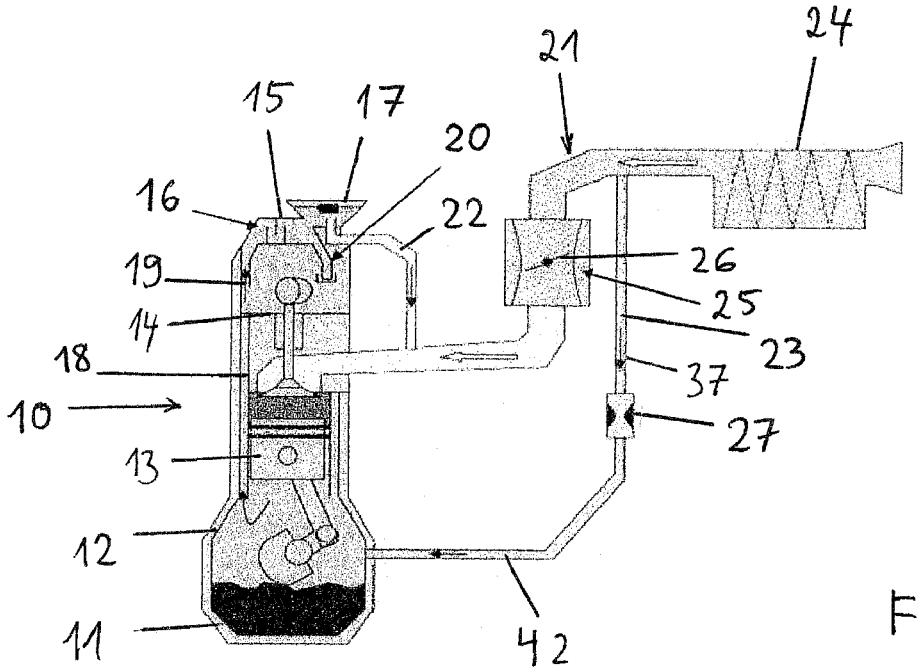

VALVE AND CYLINDER HEAD COVER FOR CRANKCASE VENTILATION OF AN INTERNAL COMBUSTION ENGINE

The invention relates to a valve for crankcase ventilation of an internal combustion engine, and a cylinder head cover with such valve integrated.

Valves for crankcase ventilation are known for instance from DE 101 53 120 A1 and JP 2003 090207 A. The respective valve is made as a check valve. It is therefore not possible to provide deventilation of the crankcase, which can be desirable particularly for full-load operation, via the ventilation line.

U.S. Pat. No. 5,499,604 discloses a PCV-valve in a deventilation line connected upstream of the throttle valve. Known PCV-valves (see for instance U.S. Pat. No. 2,407,178, U.S. Pat. No. 3,766,898, U.S. Pat. No. 4,686,952, US 2003-0213479 A1), however, are disadvantageous in that, due to the comparatively large mass of the valve cone to be moved and the necessity of a thrust spring, they work relatively inert and do not therefore satisfy the requirements of modern engine control. In addition, the opening cross-section depends on the respectively prevailing excess pressure.

An air valve to be installed between the crankcase and the intake section is known from DE 10 2005 043 735 A1, which comprises a valve disc that is pre-loaded by means of a spring. When crankcase deventilation is functioning properly, the valve disc keeps the valve closed under the thrust of the pre-loaded spring. When crankcase deventilation does not function properly, the valve element will be lifted by the excess pressure inside the crankcase against the force exerted by the spring so that the valve acts in the deventilation direction as an excess-pressure limiting valve.

Umbrella-shaped ventilation/deventilation valves with an umbrella part made of flexible material are known from GB 1 514 237, U.S. Pat. No. 3,159,176, WO 2005 116497 A1, WO 98 20236 A1, JP 61 016218 A. When excess pressure prevails under the umbrella part then the umbrella part will be lifted up under flexible deformation in order to open passage orifices. Such umbrella-type valves also react relatively inertly owing to the restoring force of the umbrella-type part which has to be overcome, and the open cross-section of the orifice depends on the prevailing excess pressure. Furthermore, such umbrella-type valves are prone to wear because of permanent deformation.

Laid-open document DE 1 916 788 discloses a ventilation system for crankcase with an ventilation check valve and a separate deventilation check valve. The check valves are formed in an embodiment with a plate made of flexible material; in case excess pressure prevails under the plate, said plate will be lifted by means of flexible deformation in order to open the passage orifices. In a further deventilation line connected underneath the throttle valve a device for regulating the flow rate can be provided, which is formed in an embodiment of a sphere and a pipe piece with sections that protrude inwards. Sludge that would otherwise collect inside the pipe piece is expelled or removed through the reciprocating movement of the sphere.

Laid-open document DE 1 149 957 discloses a safety valve, in particular, for a low-pressure steam generator that works in an open position as a ventilation/deventilation valve. The valve body is displaced in a sealing position when a certain excess pressure value is reached, however, as soon as permissible maximum pressure is reached; it is displaced into a safety deventilation position against the restoring force of an elastic collar.

DE 27 02 621 A1 discloses a lid for the oil filling nozzle with an air valve pre-loaded by means of a spring and a separate deventilation valve formed as a flexible umbrella valve.

The object of the invention is to provide a quick and cost-effective valve for efficient ventilation/deventilation of the crankcase.

The invention solves this object. Owing to the omission of a thrust spring for the valve body, the valve body can be displaced rapidly from one limit stop position to the other. Even when only slight pressure differences prevail, the valve body will be displaced into the respective limit stop position and it will open a defined flow cross-section, wherein the opened flow cross-section does not depend on the magnitude of the pressure difference between the fresh-air side and the engine side, so that adequate deventilation/ventilation is provided for small pressure differences as well.

The change of flow cross-section is achieved only through the displacement of the valve insert as a whole. "As a whole" means that all parts that are firmly connected with the valve insert will be displaced together with it. In particular, the change of the flow cross-section can be attained without deformation of the valve insert, for instance, as it is the case with conventional umbrella-type valves. Due to the displacement of the valve insert without deformation is the opened flow cross-section independent of the then acting pressure. In addition, wear due to deformation is avoided.

It is essential for the invention to be able to set the flow cross-section in the deventilation direction differently from the flow cross-section in the ventilation direction. In the ventilation direction, particularly in near-idling operation, the fresh air quantity by-passed at the throttle valve can make the engine control more difficult, whilst in the deventilation direction, particularly at near-full throttle operation, a flow cross-section that is as large as possible is desired in order to avoid impermissible high excess pressure inside the crankcase. It is therefore advantageous if the valve insert at the limit stop in the deventilation direction opens a larger flow cross-section than at the limit stop in the ventilation direction. Larger cross-section preferably implies at least 25%, further preferably at least 50% greater size. Under certain conditions, it can be appropriate, however, also if the flow cross-section in the ventilation direction is greater than the flow cross-section in deventilation direction.

In view of a reduced weight and thus smaller inertia, the valve insert preferably consists of plastic, a thermoplastic elastomer and/or an elastomer. The valve insert can also be made of a combination of suitable materials, for instance, a shaft made of plastic and a disc made of thermoplastic elastomer or elastomer. The valve insert is not restricted to the above-mentioned materials, for instance, also a light metal comes in question.

Figure 2:
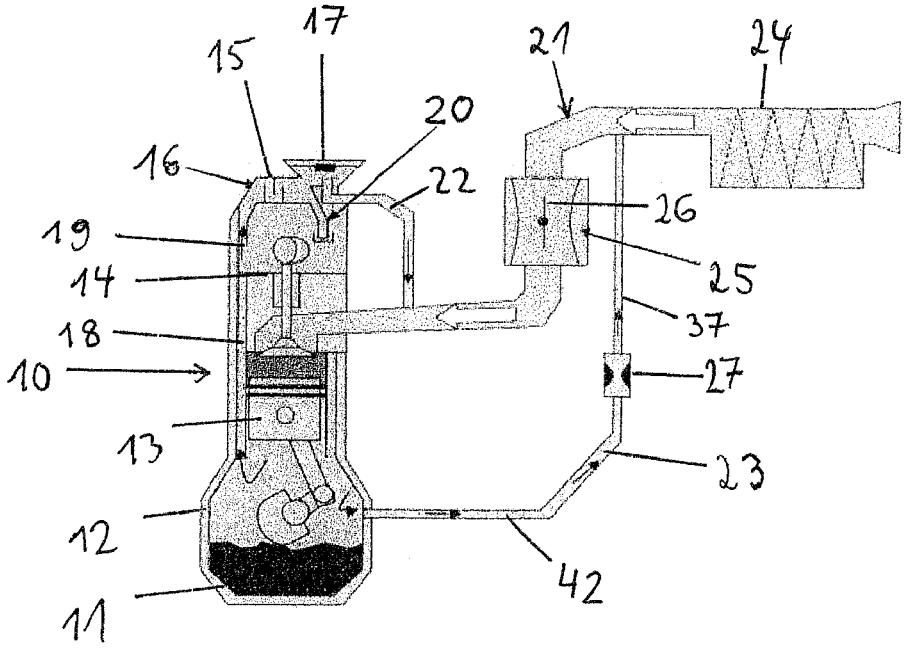
Figure 3:
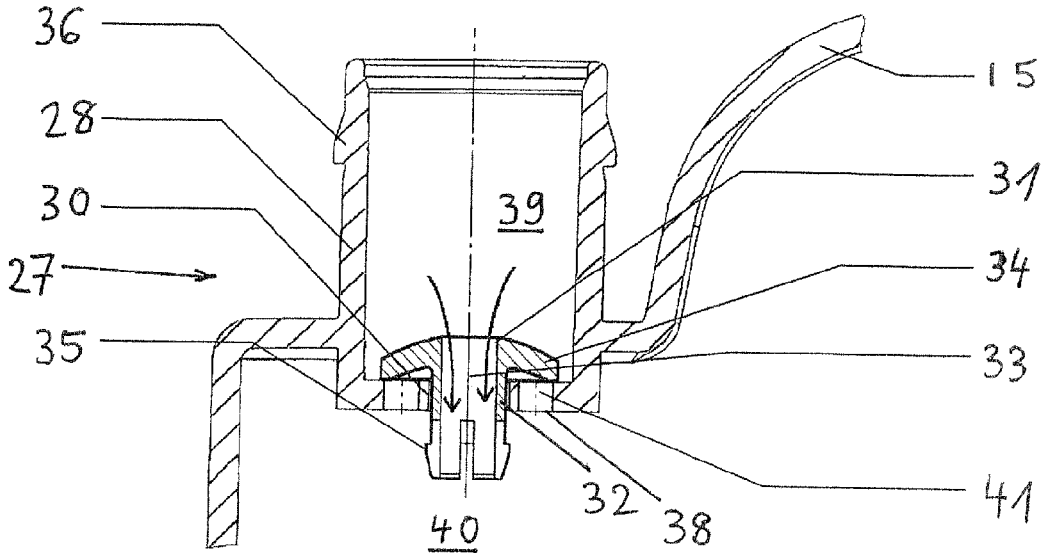

The invention is explained as follows, based on advantageous embodiments with reference to the attached figures which show:

FIG. 1: an internal combustion engine with an intake section and an essentially closed throttle valve;

FIG. 2: an internal combustion engine with an intake section and an opened throttle valve;

FIG. 3: a throttle valve in the ventilation limit-stop position; and

Figure 4:
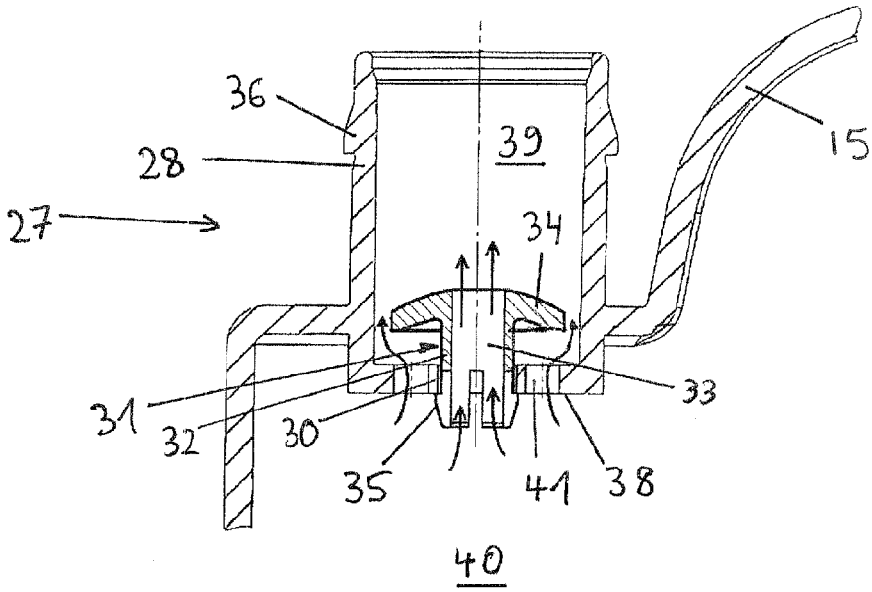

FIG. 4: a throttle valve in the deventilation limit-stop position.

The internal combustion engine 10 depicted in FIGS. 1 and 2 comprises oil sump 11, crankcase 12, cylinder 13, cylinder head 14 and cylinder head cover 15 with oil separator 16 and pressure control valve 17. Blow-by gases are passed via channels 18 inside the engine block to a gas inlet 19 into the cylinder head cover 15 and pass through the oil separator 16 where separated oil flows back through the oil return line 20 into the engine oil circuit and the cleaned gas is passed via the pressure control valve 17 and a deventilation line 22 back into the intake section 21.

In addition to the above-described deventilation of the crankcase 12, ventilation of the crankcase 12 is provided via line 23 connecting the intake section 21 with the crankcase 12. This is particularly appropriate for Otto engines in which the water and/or the fuel content in the blow-by gas is comparatively high.

Should the ventilation occur through line 23 without external power, then pressure gradient is required from the point of fresh air supply from the intake section 21 up to the introduction of air enriched with water and fuel vapours together with the blow-by gas in the intake section 21 via line 22. In general, the line 23 for fresh air supply therefore branches from the intake section 21 after the air filter 24 and before the throttle valve element 25 with the throttle valve 26, whilst the line 22 for discharge leads into the intake section 21 after the throttle valve element 25. "Before" and "after" thereby refer to the flow direction of combustion air.

The precondition for ventilation is furthermore a sufficient pressure gradient between the tapping point before and the discharge point after the throttle valve element 25 that is at least present for a partially closed throttle valve 26. Ventilation is therefore only possible in the idling state with a closed throttle valve 26 or in a partial-load operation state with a partially closed throttle valve 26, as shown in FIG. 1.

In particular, in near-idling operation, the fresh air volume bypassing the throttle valve 26 via the lines or channels 23, 18, 22 can make engine control to become more difficult. To counteract this effect, a valve 27 for metering the fresh air volume for ventilating the crankcase 12 is located in line 23.

By further opening the throttle valve 26, i.e., by increasing the load up to full engine load, the pressure rises inside the crankcase 12 above the pressure upstream of the throttle valve 26 due to the increase of blow-by gases. Valve 27 is realised as a two-way element so that the flow direction in line 23 for deventilating the crankcase can reverse. Line 23 therefore serves as a ventilation and deventilation line depending on the pressure relations.

A preferred embodiment of valve 27 is shown in the FIGS. 3 and 4. The valve 27 comprises a pipe-shaped housing part 28 and particularly a housing wall part 38 that separates a fresh-air side 39 of the valve 27 from an engine side 40. The housing wall part 38 is appropriately essentially perpendicular to the flow direction through valve 27.

On a fresh-air-side end 39, the tubular housing part 28 for instance can feature a hose connection nipple 36 for connecting a hose 37 for connection with the intake section 21.

The engine side 40 of valve 27 is in connection with the engine crankcase 12. When valve 27 is a separate component, this can be a hose connection 42 for instance (see FIGS. 1 and 2). When, as shown in the preferred embodiment according to FIGS. 3 and 4, valve 27 is integrated in the cylinder head cover 15, in which the engine side 40 of valve 27 is particularly located in the gas inlet 19 section of the cylinder head cover, then the engine side 40 is connected via channel 18 for the blow-by gas with the crankcase 12 and an additional, external hose or line connection is dispensable.

A valve insert 31 is movably mounted in valve 27. To be precise, the valve insert 31 comprises a shaft 32 that is mounted in a movable manner in a bore 30 of housing wall part 38.

Valve insert 31 further comprises a first limit stop, here in the form of disc 34 on the fresh-air-side end of shaft 32 and a further limit stop 35 on the opposite engine-side end of shaft 32. The other limit stop 35 in the present example is formed by hook-shaped tongues on the engine-side end of the valve insert 31. Using the hook-shaped tongues 35 the valve insert 31 can be latched from the fresh-air side 39 into the bore 30 and is then held inside via a corresponding clip-type connector such that it cannot get lost.

Inside the housing wall part 38 there are other passage openings 41 provided radially outside the bore 33, however within the surface covered by the disc 34.

When the pressure on the fresh-air side 39 of the valve 27 is higher than the pressure on the engine side 40, the valve insert will be shifted automatically into the limit-stop position depicted in FIG. 3, in which the disc 34 comes in contact with the housing wall part 38 and thereby covers the passage openings 41. In this limit-stop position, fresh air can be supplied to crankcase 12 through a passage bore 33 of the shaft with a defined cross-section. "Automatically" means without additional control means and without external power, solely based on pressure difference.

When, on the other hand, the pressure on the fresh-air side 39 of valve 27 is lower than the pressure on the engine side 40, then the valve insert will be lifted automatically in the opposite limit-stop position, as depicted in FIG. 4, in which the hook-shaped tongues 35 come in contact with the housing wall part 38. In this limit-stop position, the flow direction is reversed and blow-by gas can be discharged, on the one hand, through the passage bore 33 of the shaft out of crankcase 12. Simultaneously, the disc 34 opens the passage openings 41 so that blow-by gas can be additionally discharged through the passage openings 41 from the crankcase 12. The flow cross-section is therefore larger in the deventilation direction than the flow cross-section in ventilation direction, by a magnitude equal to the flow cross-section of passage openings 41. By means of this, efficient deventilation and throttled ventilation of the crankcase can be achieved with regard to stable engine control.

As described earlier, there are only two stable positions for the valve insert 31 based on the two limit-stop positions, namely deventilation and ventilation position. Between these two stable positions, the valve insert 31 is freely movable without, for instance, having to overcome a pre-load force exerted by a spring. Just a small pressure difference between the fresh air and the engine side of valve 27 is enough for the valve insert 31 to be shifted into the corresponding limit-stop position and to open the cross-section for maximum deventilation or ventilation. In this regard, the valve 27 differs from the ventilation valve according to DE 10 2005 043 735 A1, in which the valve body must be moved against the force of a thrust spring in the ventilation direction and the maximum ventilation cross-section only opens under substantial excess pressure inside the crankcase.

In a not shown embodiment passage openings can be provided between the fresh-air side 39 and the engine side 40, instead of or in addition to the passage bore 33 of the valve insert 31, which are opened independently of the position of the valve insert 31. The shaft 32 therefore must not necessarily be a hollow shaft; it can also be solid.

In the embodiments shown in the Figures, the valve is integrated in the cylinder head cover 15. However, the valve may also be contained in a separate unit.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

The invention claimed is:

1. A valve for crankcase ventilation of an internal combustion engine, said valve comprising a fresh-air side for connection with an intake section of the internal combustion engine, an engine side for connection with the crankcase and a valve insert movable as a whole for changing the flow resistance through the valve, wherein said valve insert is held inside said valve without pre-load, wherein said valve insert is designed to be freely displaced to a deventilation limit-stop position at which deventilation occurs under negative pressure on the fresh-air side relative to the engine side, and to be freely displaced to a ventilation limit-stop position at which ventilation occurs under excess pressure on the fresh-air side relative to the engine side, wherein the valve insert is designed to open a deventilation cross-section in the deventilation limit-stop position and to open a ventilation cross-section that is different from the deventilation cross-section in the ventilation limit-stop position.

2. The valve according to claim 1, wherein the valve is designed to have a flow resistance in the deventilation limit-stop position less than in the ventilation limit-stop position.

3. The valve according to claim 1, wherein the valve insert is made of a plastic, a thermoplastic elastomer and/or an elastomer.

4. The valve according claim 1, comprising at least one passage opening inside the valve, wherein the valve insert comprises a cover element for covering said at least one passage opening.

5. The valve according to claim 4, wherein said cover element is designed to open said at least one passage opening in the deventilation limit-stop position and to cover it in the ventilation limit-stop position.

6. The valve according to claim 4, wherein said cover element has a disc-like shape.

7. The valve according to claim 4, wherein the cover element forms one of said limit stops.

8. The valve according to claim 1, wherein the valve insert comprises a shaft mounted to hold said valve insert in a displaceable manner.

9. The valve according to claim 1, comprising a housing wall part with a bore, wherein said valve insert is mounted within said bore in a displaceable manner.

10. The valve according to claim 9, wherein at least one passage opening is provided inside the housing wall part in addition to the bore.

11. The valve according to claim 1, wherein the valve insert comprises a passage bore.

12. A cylinder head cover for an internal combustion engine, comprising a valve for crankcase ventilation, said valve comprising a fresh-air side for connection with an intake section of the internal combustion engine, an engine side for connection with the crankcase and a valve insert movable as a whole for changing the flow resistance through the valve, wherein said valve insert is held inside said valve without pre-load, wherein negative pressure on the fresh-air side relative to the engine side causes a free displacement of the valve insert to a deventilation limit-stop position at which deventilation occurs and excess pressure on the fresh-air side relative to the engine side causes a free displacement of the valve insert into ventilation limit-stop position at which ventilation occurs, wherein the valve insert in the deventilation limit-stop position opens a deventilation cross-section and in the ventilation limit-stop position opens a ventilation cross-section that is different from the deventilation cross-section.

13. The cylinder head cover according to claim 12, said combustion engine comprising an air filter and a throttle valve element, wherein said fresh-air side of said valve is connected to said intake section between said air filter and said throttle valve element.

14. The cylinder head cover according to claim 12, wherein the valve is designed to have a flow resistance in the deventilation limit-stop position less than in the ventilation limit-stop position.

15. The cylinder head cover according claim 12, comprising at least one passage opening inside the valve, wherein the valve insert comprises a cover element for covering said at least one passage opening.

16. The cylinder head cover according to claim 15, wherein said cover element is designed to open said at least one passage opening in the deventilation limit-stop position and to cover it in the ventilation limit-stop position.

17. The cylinder head cover according to claim 15, wherein said cover element has a disc-like shape.

18. The cylinder head cover according to claim 15, wherein the cover element forms one of said limit stops.

19. The cylinder head cover according to claim 12, wherein the valve insert comprises a shaft mounted to hold said valve insert in a displaceable manner.

20. The cylinder head cover according to claim 12, comprising a housing wall part with a bore, wherein said valve insert is mounted within said bore in a displaceable manner.

21. The cylinder head cover according to claim 20, wherein at least one passage opening is provided inside the housing wall part in addition to the bore.

22. The cylinder head cover according to claim 12, wherein said valve insert comprises a passage bore.

* * * * *